US006305753B1

(12) United States Patent
Rodrigues

(10) Patent No.: US 6,305,753 B1
(45) Date of Patent: Oct. 23, 2001

(54) HYDRAULIC EXPANSION TUBE

(76) Inventor: Casiano Glenie Rodrigues, 20 Haida Court, West Hill, Ontario (CA), M1C 3L1

( * ) Notice: Subject to any disclaimer, the term of this patent is extended or adjusted under 35 U.S.C. 154(b) by 0 days.

(21) Appl. No.: 09/262,695

(22) Filed: Mar. 4, 1999

(51) Int. Cl.[7] ..... E21C 37/10
(52) U.S. Cl. ..... 299/21; 166/187
(58) Field of Search ..... 299/20, 21; 166/179, 166/187

(56) References Cited

U.S. PATENT DOCUMENTS

| | | | | |
|---|---|---|---|---|
| 3,542,127 | * | 11/1970 | Malone | 166/187 |
| 3,918,520 | * | 11/1975 | Hutchison | 166/187 |
| 4,630,691 | * | 12/1986 | Hooper | 166/187 |
| 4,923,007 | * | 5/1990 | Sanford et al. | 166/187 |
| 4,968,100 | | 11/1990 | Corneil | 299/21 |
| 5,000,517 | | 3/1991 | Lebedev | 299/21 |
| 5,048,605 | * | 9/1991 | Toon et al. | 166/187 |
| 5,398,998 | | 3/1995 | Evans | 299/21 |
| 5,676,427 | | 10/1997 | Ha | 299/21 |

FOREIGN PATENT DOCUMENTS

WO 86/02404 4/1986 (WO) .

WO 93/10330 5/1993 (WO) .

OTHER PUBLICATIONS

U.S. application No. 09/247,529, Mantha et al., filed Feb. 10, 1999.

U.S. application No. 09/261,393, Mantha et al., filed Mar. 3, 1999.

* cited by examiner

*Primary Examiner*—David Bagnell
*Assistant Examiner*—John Kreck
(74) *Attorney, Agent, or Firm*—Kolisch Hartwell Dickinson McCormack & Heuser

(57) ABSTRACT

An hydraulic expansion tube is provided which may be inserted into bore holes and expanded to break apart rock. An expandable tube is secured at its ends with end caps and sleeves which are carried on a support shaft. The end caps and sleeves form a tight interference fit with the ends of the expandable tube. Hydraulic fluid is ported through the support shaft into the interior of the expandable tube. The end caps and sleeves may be provided with threads to better grip the expandable tube and prevent it from pulling away from the end caps after repeated expansion. Additionally, an expandable sheath may be provided to surround the ends of the expandable tube to limit the expandable tube from flowing around the end caps when pressurized.

8 Claims, 4 Drawing Sheets

HYDRAULIC EXPANSION TUBE

FIELD OF THE INVENTION

This invention relates to hydraulic expansion tubes which may be used in mining, construction and excavation.

BACKGROUND OF THE INVENTION

In mining, construction and excavation operations it is often necessary to break apart large portions of solid rock. Traditionally, surface pieces of rock could be broken away using rock chisels and/or hammers. In order to break apart larger portions of rock a wedge may be used to split the rock apart. However, these methods are both labour intensive and time consuming.

Since the advent of explosives, dynamite has often been used to break apart larger portions of rock. Typically, the dynamite is inserted into a bore hole that is drilled into the rock. When the dynamite explodes the pressure generated by the explosion or blast inside the bore hole splits the rock apart. Such explosions may be used alone or in conjunction with each other to break apart large portions of rock in a short period of time.

However, the explosive nature of dynamite makes it very dangerous to work with. Extensive safety precautions must be employed in the storage, transportation and use of dynamite. Additionally, when dynamite explodes it destroys itself, the detonating caps and much of the detonating wire. Accordingly, these components are non-reusable and must be replaced with each new use. Furthermore, the explosion of dynamite creates a shockwave that is both loud and potentially damaging to sensitive structures. As such, dynamite blasting is often prohibited in urban areas.

SUMMARY OF INVENTION

In accordance with an aspect of the present invention there is provided an expander, comprising a support shaft, a pair of sleeves received on the support shaft proximate either end of the support shaft, an expandable tube disposed about the support shaft and the sleeves, a pair of end caps proximate either end of the support shaft surrounding the expandable tube such that proximate each end of the support shaft an end cap and a sleeve sandwich said expandable tube so as to make an interference fit with the expandable tube, and a port for porting hydraulic fluid between said support shaft and said expandable tube.

In accordance with another aspect of the present invention there is provided an expander an described above further comprising an expandable sheath disposed about said expandable tube at each said end cap for minimizing expansion of said expandable tube over said end cap.

The present invention may be inserted into a bore hole to split apart rock. An advantage of the present invention is that is it quiet, reusable and does not generate an explosive shock wave. The absence of an explosion makes the present invention safer to use and better suited for use in urban areas.

BRIEF DESCRIPTION OF THE DRAWINGS

The present invention will be further understood from the following detailed description, with reference to the drawings in which:

FIG. 3 illustrates an exploded view of the expander in FIG. 1 absent the sheathes and with a portion of the expandable tube cut away to expose the support shaft inserted there through.

DETAILED DESCRIPTION OF THE PREFERRED EMBODIMENT

Figure 1:
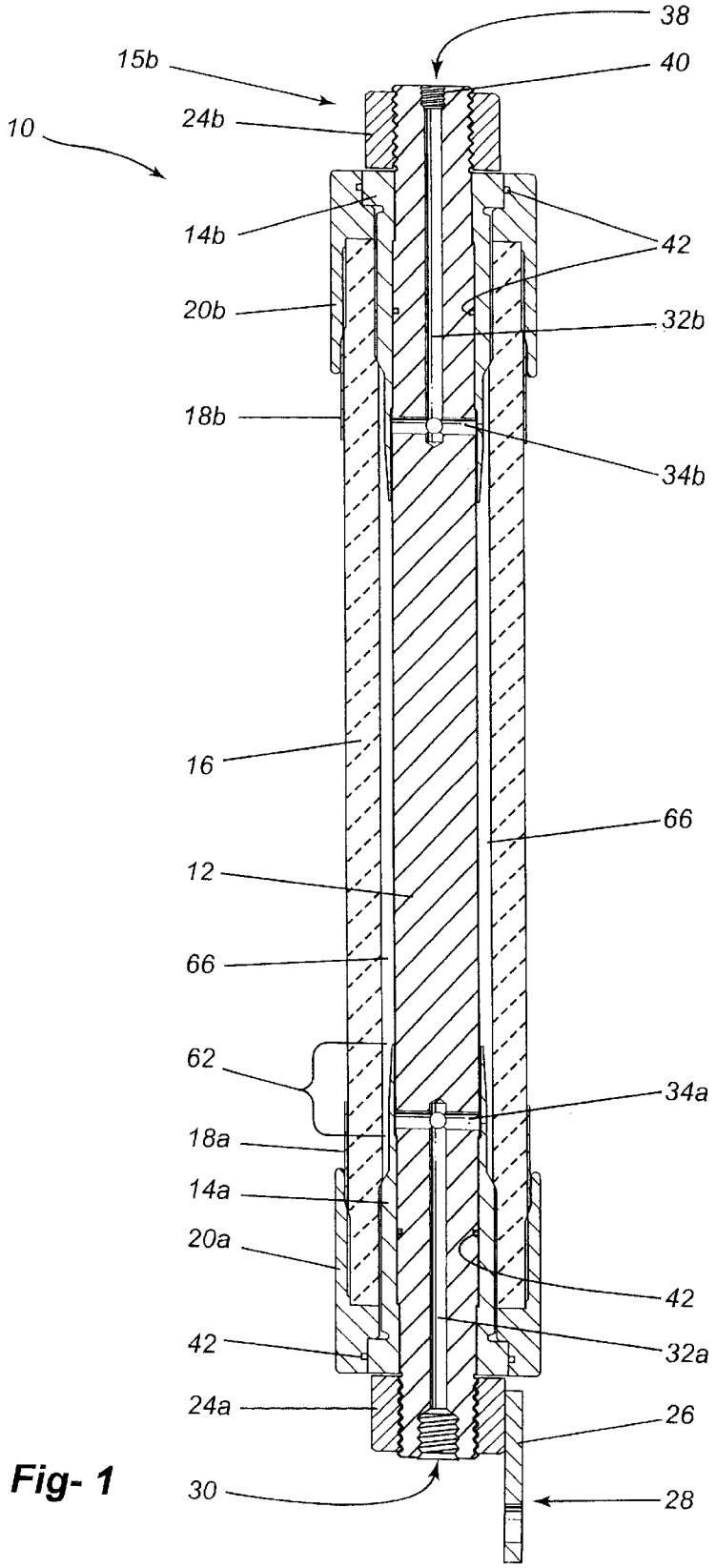
FIG. 1 illustrates in cross-section a side view of an unexpanded expander in accordance with an embodiment of the present invention.

Referencing FIGS. 1 to 4, an expander 10 comprises a support shaft 12 with a pair of sleeves 14*a*, 14*b* received thereon proximate either end 15*a*, 15*b* of the shaft. An expandable tube 16 is disposed about the support shaft and the sleeves 14*a*, 14*b*. The tube is preferably elastic, being preferably formed of rubber, and most preferably nitrile rubber. A pair of sheathes 18*a*, 18*b* near each end of the support shaft 12 surround the rubber tube and a pair of end caps 20*a*, 20*b* proximate each end of the shaft surround the rubber tube and a portion of the sheathes 18*a*, 18*b*. The sheathes have some elasticity, but are preferably less elastic than the rubber tube. The sheathes may be made of nylon. The ends of the support shaft are threaded and receive end nuts 24*a*, 24*b*. Nut 24*a* has a tab 26 with an opening 28 therein.

The support shaft has an hydraulic port 30 through end 15*a* which connects with an input conduit 32*a* that ends in radial stub conduits 34*a* which open to the outside of the shaft. The end 15*b* of the shaft 12 has a bleed port 38 connected to a bleed conduit 32*b* which ends in radial stub conduits 34*b* which open to the outside of the shaft. A bleed end cap 40 seals the bleed port 38. A series of O-rings 42 provide seals against hydraulic fluid leakage.

Figure 2:
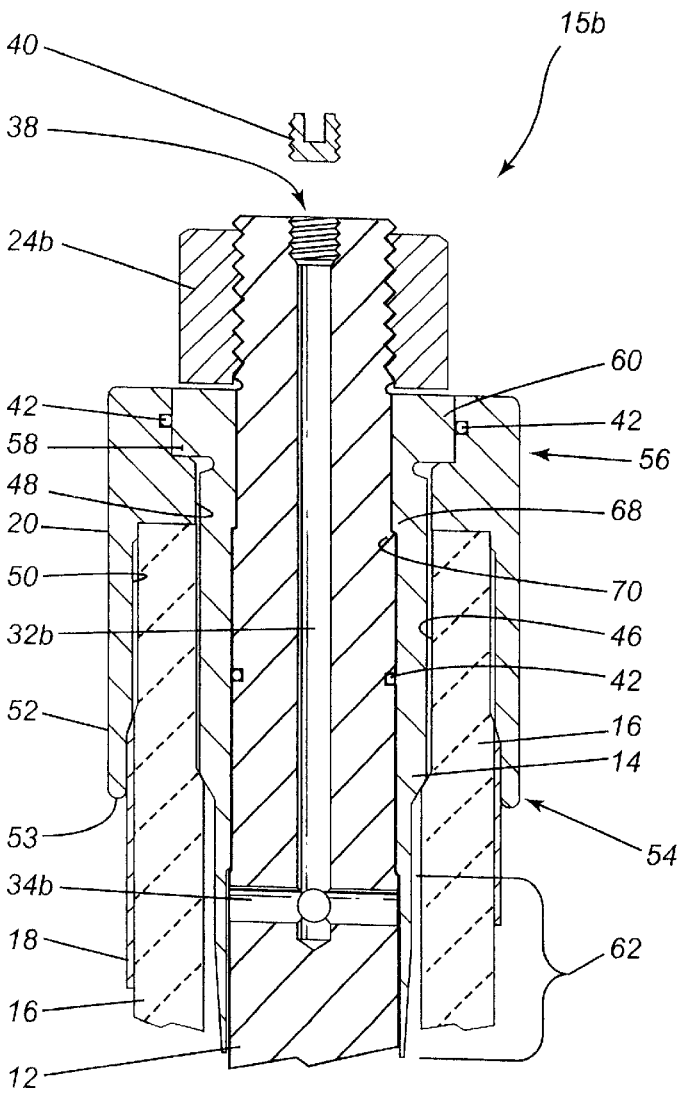
FIG. 2 illustrates in cross-section an enlarged side view of the left hand end of the unexpanded expander shown in FIG. 1.
Figure 3:
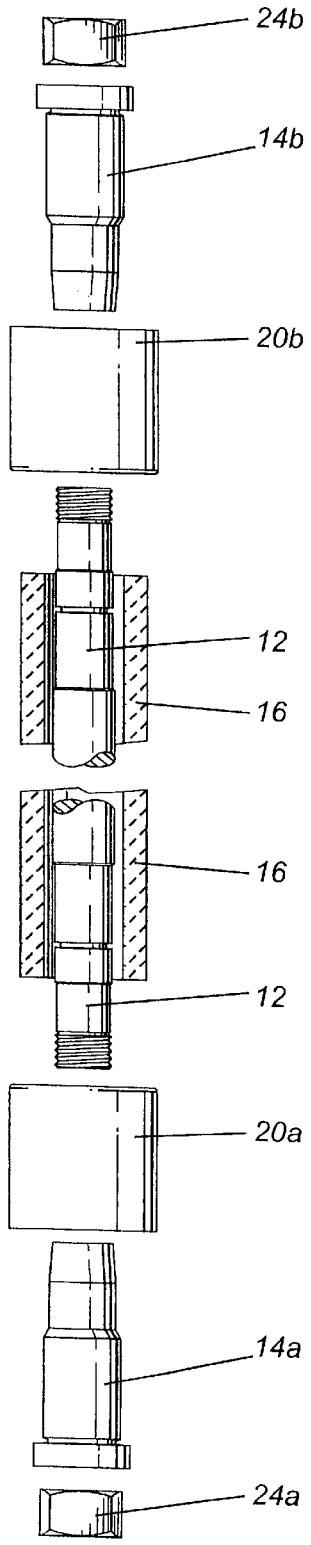
Figure 4:
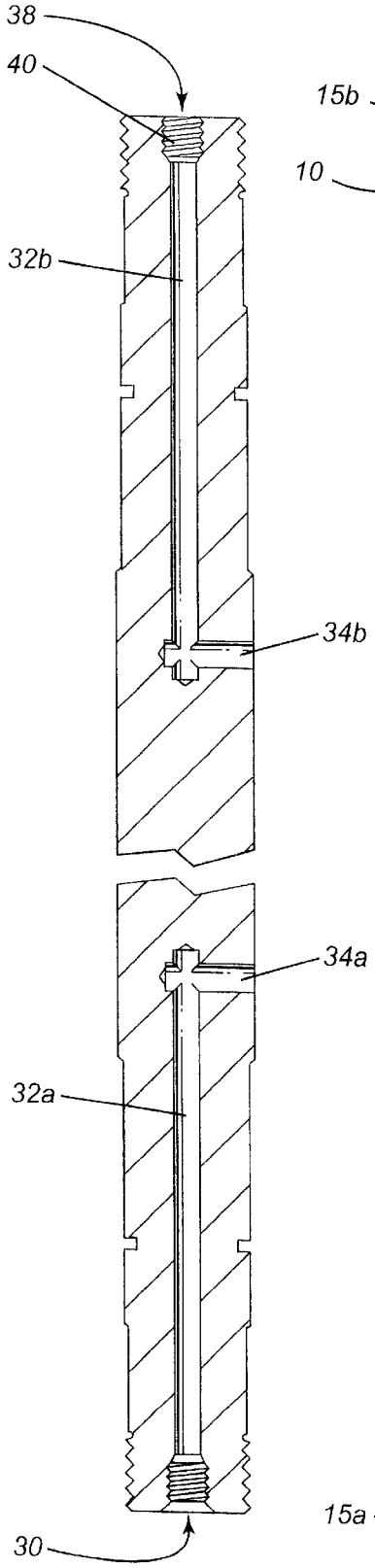
FIG. 4 illustrates in cross-section an enlarged side view of the support shaft shown in FIG. 1.

As best seen in FIG. 2, a portion 46 of the exterior of each sleeve 14 is threaded and a portion 48 of the interior of each end cap 20 is also threaded. The sleeve and end cap are configured so that these threaded portions mate so that the sleeve may be threaded to the end cap. A further portion 50 of the end cap 20 is threaded with a thread opposite in orientation to that of the threaded portion 46 of the sleeve, and it will be noted that each end of the rubber tube is sandwiched between an end cap and sleeve at their threaded portions 46, 50, respectively, in order that the grip on the tube by the end cap and sleeve combination is enhanced.

The end cap 20 terminates in an apical unthreaded lip portion 52 with a rounded edge 53 under which the sheath 18 extends. The outside surface of the end cap 20 tapers from a wide apex 54 at lip portion 52 to a narrow base 56. The end cap also has a shoulder 58.

The sleeve 14 has a basal flange 60 which abuts against shoulder 58 of the end cap and an apical interior radially stepped portion 62. The sleeve 14 is spaced from the shaft 12 along portion 62 and portion 62 extends over the radial stub conduits 34 of the shaft. The sleeve 14 also has a shoulder 68 which abuts a corresponding shoulder 70 of shaft 12.

Figure 5:
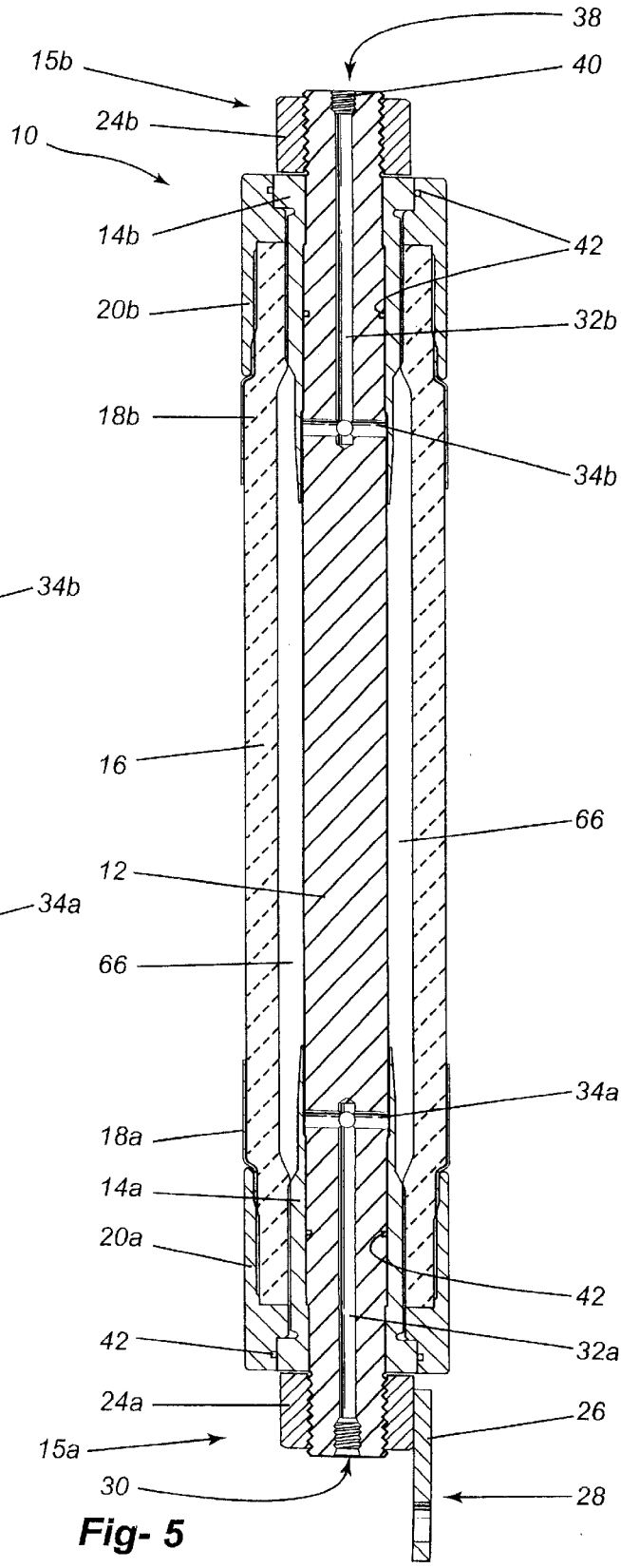
FIG. 5 illustrates in cross-section a side view of an expander of FIG. 1 when expanded and confined by a bore hole.

Turning to FIG. 5, in operation, expander 10 may be inserted in a bore hole through rock. Pressurised hydraulic fluid is then injected into the expander through port 30. The fluid squirts through conduit 32*a* and stub conduits 34*a* exiting the support shaft 12 at portion 62 of sleeve 14*a*. Portion 62 of the sleeve redirects the fluid flow so that the pressurised fluid does not squirt directly onto the rubber tube 16 (which could damage the tube). The fluid fills the annular space 66 between the support shaft and the rubber tube and the fluid pressure forces the medial section of the rubber tube between the end caps 20*a*, 20*b* to expand against the sides of the borehole. It has been found that pressures of 2,000 to 10,000 psi are typically required to fracture the rock through which such a borehole extends. Once the rock fractures, the pressure quickly drops as the rubber tube is freed to expand; this pressure drop may be used as a feedback signal to cut off the hydraulic fluid supply. It is also contemplated that several expanders 10 may be connected in series (by coupling the bleed port 38 of one expander to the hydraulic port of the next through a suitable coupling) to extend the operational length.

While the rubber tube 20 expands, each sheath 18*a*, 18*b* acts to minimize expansion of the expandable tube 16 over the outside surface of the end cap 20*a*, 20*b* with which it is associated. This greatly reduces fatigue of the rubber and therefore prolongs the life of the rubber tube 16.

After the rock has been fractured and the hydraulic fluid cut off, the expander 10 may be removed from the borehole by a suitable hook received through opening 28 in tab 26.

When expander 10 is first hooked up to an hydraulic supply, the expander will contain air rather than hydraulic fluid. Pressurising this air to the working pressures of the expander could result in dangerous failure. Consequently, after first hooking the expander to an hydraulic supply, bleed end cap 40 is removed and low pressure fluid is introduced into the expander. This forces the air out of the expander through bleed conduit 32*b*. Once fluid begins to emerge from bleed port 38, the bleed end cap 40 may be reinserted to close bleed port 38.

The size of the bore hole is such that the wide apex 54 of the end caps makes a close tolerance fit with the sides of the bore hole. This further assists in ensuring that the rubber of the tube does not expand around the outside of the end caps. Lip 52 is provided with a rounded edge 53 to prevent sheaths 18 and expandable tube 16 from being pinched and damaged during expansion. The end caps are tapered from their wide apices to ease manipulation of the expander in the borehole.

The interference fit that the threaded end cap and sleeve portions make with the ends of the rubber tube provides a strong bite on the rubber tube which minimized its creep away from the base 56 of the end caps with repeated use.

The expander may be assembled as follows. First the end caps 20*a*, 20*b* are turned while they are pressed against the ends of the rubber tube so that they "screw" onto the tube. Next the support shaft is inserted through the rubber tube. After this, each sleeve 14*a*, 14*b* is screwed into its end cap 20*a*, 20*b* until the shoulder 68 of the sleeve abuts the shoulder 70 of the shaft 12. This pinches the rubber tube between the sleeves and end caps. Lastly the end nuts 24*a*, 24*b* are threaded to the threaded ends 15*a*, 15*b* of the shaft 12. When it is necessary to replace a fatigued rubber tube 16, this process is reversed.

Optionally, the bleed end cap 40 may be replaced by a spring loaded valve which may be opened by a user applying external pressure. Optionally, instead of tapering the end caps, they may simply have an enlarged apical lip.

The nylon sheathes have the disadvantage that they may slowly break down in a caustic environment. Optionally, therefore, the nylon sheathes may be replaced with a coil spring or by a flat steel spring. Further, the sheathes may optionally not be overlapped by the end caps but, instead, terminate at the apical edge of the end caps. This option is not preferred, however, as sheathes so positioned provide less protection against the rubber tube expanding over the outside of the end caps.

Figure 6:
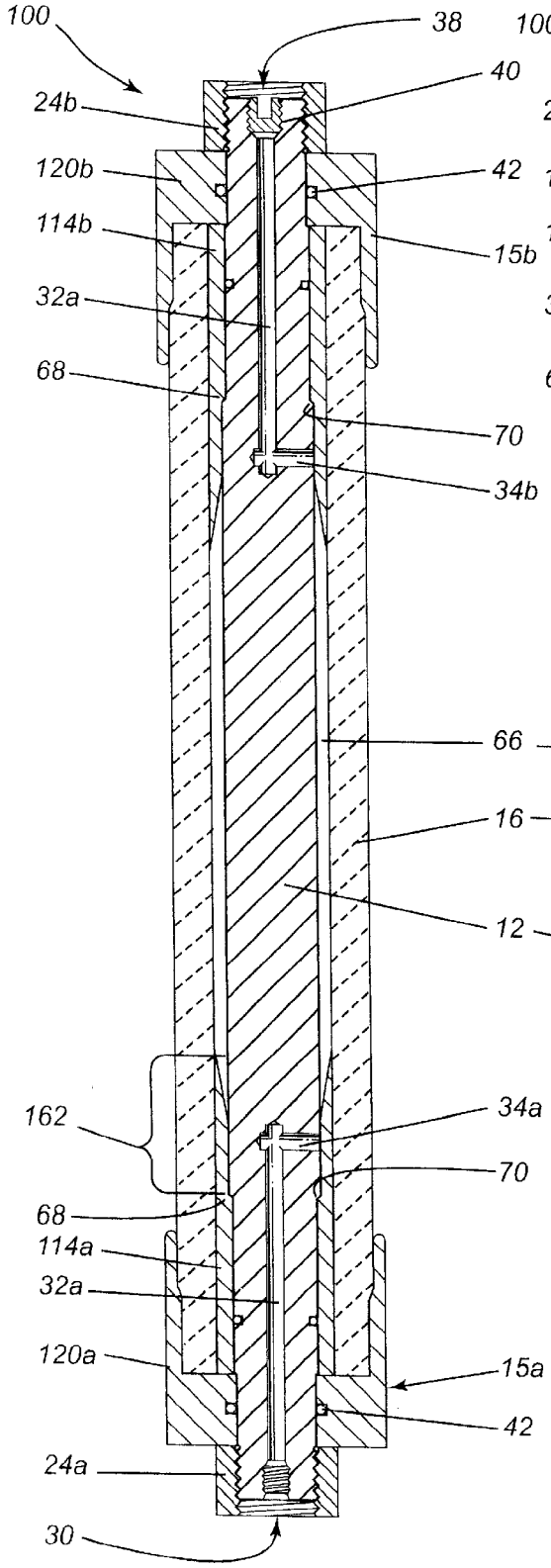
FIG. 6 illustrates in cross-section a side view of an unexpanded expander in accordance with a second embodiment of the present invention.

A simplified embodiment of an expander made in accordance with this invention is illustrated in FIG. 6. Turning to FIG. 6, wherein like parts have been given like reference numerals, expander 100 has sleeves 114*a*, 114*b* which are not threaded. Each sleeve abuts basal portion 156 of an end cap 120*a*, 120*b*. The end caps 120*a*, 120*b* are also not threaded. And no sheathes are employed in expander 100. Expander 100 is assembled by placing sleeves 114*a*, 114*b* over the end portions of the support shaft 12 until the shoulders 68 of the sleeves abut the shoulders 70 of the shaft 12, pushing the rubber tube 16 onto the shaft 12 then forcing on the end caps 120*a*, 120*b*. In forcing an end cap overt the rubber tube, air will become trapped between the end of the rubber tube and the basal portion 156 of the end cap. To avoid this potential problem, preferably a bleed conduit (not shown) is provided through the base of the end cap to allow this air to escape. After the end caps are in place, the end nuts 24*a*, 24*b* may be threaded to the assembly.

Figure 7:
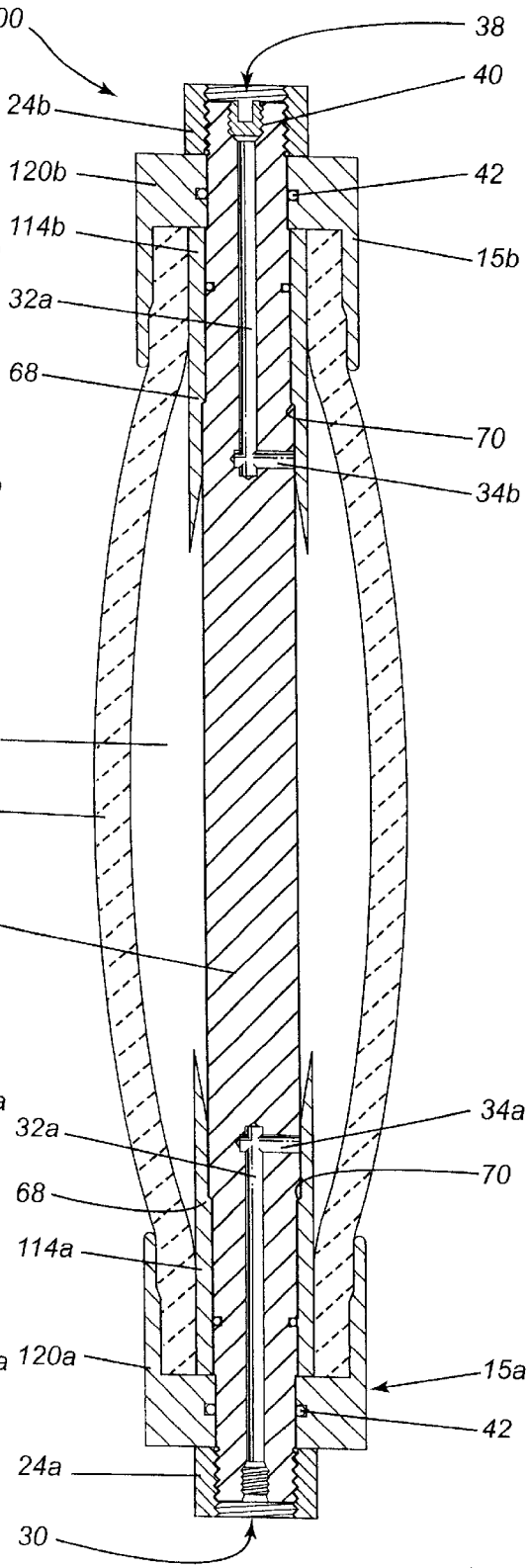
FIG. 7 illustrates in cross-section a side view of the expander of FIG. 6 when expanded and not confined by a bore hole.

Referencing FIG. 7, after assembly, hydraulic fluid may then be injected into port 30. The fluid will squirt through stub conduits 34*a* and be redirected by apical portion 162 of sleeve 114*a*. The fluid in annular space 66 will then cause the rubber tube 16 to expand. The tight interference fit between the sleeves 114*a*, 114*b* and the end caps 120*a*, 120*b* minimizes creep of the tube away from the basal portions 156 of the end caps.

Other modifications will be apparent to those skilled in the art.

What is claimed is:

1. An expander, comprising:

a support shaft;

a pair of sleeves disposed about on said support shaft proximate either end of said support shaft;

an expandable tube disposed about said support shaft and said sleeves;

a pair of end caps proximate said either end of said support shaft surrounding said expandable tube such that, proximate each end of said support shaft, one of said end caps and one of said sleeves pinch said expandable tube;

a port for porting hydraulic fluid between said support shaft and said expandable tube;

a pair of expandable sheaths disposed about said expandable tube at each of said end caps, each of said sheathes capable of minimizing expansion of said expandable tube over one of said end caps, wherein each of said end caps overlaps an end of one of said sheaths; and a bleed for bleeding air from between said support shaft and said expandable tube.

2. The expander of claim 1 wherein said sleeves are externally threaded with threads gripping said expandable tube.

3. The expander of claim 2 wherein said end caps are internally threaded with threads gripping said expandable tube.

4. The expander of claim 3 wherein each of said end caps has a maximum outside diameter at an apical, inner, end.

5. The expander of claim 4 wherein an outside diameter of each of said end caps tapers from said apical end.

6. The expander of claim 5 wherein one of said sleeves extends between an outlet of said port and said expandable tube.

7. The expander of claim 6 wherein said expandable tube is made of rubber.

8. The expander of claim 6 wherein said expandable tube is made of nitrile.

* * * * *